US008259969B2

(12) United States Patent
Xi

(10) Patent No.: US 8,259,969 B2
(45) Date of Patent: Sep. 4, 2012

(54) HIGH-FREQUENCY PNEUMATIC LOUDSPEAKER FOR AUDIO BROADCASTING

(75) Inventor: Baoshu Xi, Beijing (CN)

(73) Assignee: Bejing Wave Energy Technology Development Company, Ltd., Beijing (CN)

( * ) Notice: Subject to any disclaimer, the term of this patent is extended or adjusted under 35 U.S.C. 154(b) by 1436 days.

(21) Appl. No.: 11/881,434

(22) Filed: Jul. 27, 2007

(65) Prior Publication Data

US 2008/0212806 A1 Sep. 4, 2008

(51) Int. Cl.
*H01R 25/00* (2006.01)

(52) U.S. Cl. ..... 381/165

(58) Field of Classification Search ..... 381/165, 381/164, 337

See application file for complete search history.

(56) References Cited

U.S. PATENT DOCUMENTS 6,837,333 B2 * 1/2005 Howze ..... 181/148

FOREIGN PATENT DOCUMENTS

CN ZL92102274.3 9/1992

OTHER PUBLICATIONS

W.R.Miller , development of a wide band, ten kilowatt acoustic noise source, Ling Electronics.

* cited by examiner

*Primary Examiner* — Kevin M Picardat
*Assistant Examiner* — Neil Prasad
(74) *Attorney, Agent, or Firm* — Oliff & Berridge, PLC

(57) ABSTRACT

A high-frequency pneumatic loudspeaker for sound broadcasting is provided, and comprises a housing, silencer exhaust holes, air inlet port, supporting plate, throat canal, central cone, annular nozzle, obstructing ring, and a voice coil and leads. Lower and an upper press plates hold the obstructing ring and the voice coil in position, a magnet having inner and outer magnetic poles is connected therewith, wherein a small gap exists between the obstructing ring and the end of the annular nozzle. This provides the advantages of both air passage area modulation by a sleeve air valve and airstream direction modulation by jet obstruction, reduces airstream consumption, improves air-sound conversion efficiency, and improves structures of an annular air flow-splitter, voice coil and leads. A cooling system is provided to improve high-frequency modulation sensitivity, operation stability, and/or extended fault-free operation time.

4 Claims, 6 Drawing Sheets

HIGH-FREQUENCY PNEUMATIC LOUDSPEAKER FOR AUDIO BROADCASTING

CROSS REFERENCE TO RELATED APPLICATION

This application claims priority under 35 USC 119(a)-(f) from pending Chinese patent application number 200710064137.3, filed Mar. 2, 2007.

FIELD OF THE INVENTION

The present invention relates to a loudspeaker, particularly to a structural design of a high-frequency pneumatic loudspeaker for audio broadcasting.

BACKGROUND OF THE ART

Most of the loudspeakers presently used for broadcasting voice or music are electrodynamic loudspeakers. These loudspeakers have wide range of frequency, so they can clearly broadcast various audio signals, but their single-unit acoustic power is limited. Currently, the electrical power of a single loudspeaker is usually under 1,000 Watts. When broadcasting in greater power is needed, it is usually necessary to combine a plurality of loudspeakers; even so, it is still not possible to meet the requirements of large area, long distance or high sound-intensity broadcasting.

A pneumatic loudspeaker uses an electrical signal to modulate a high-pressure airstream, which is similar to the mechanism of human voice generation, and can produce very strong sound. Currently, the acoustic power of a single sound-generating unit can be over 10,000-20,000 acoustic Watts, which equivalent to 50,000-100,000 Watts of the electrical power of an electrodynamic loudspeaker. But the frequency range of a pneumatic loudspeaker is narrow and can hardly be over 2,500 Hz, so its sound definition is bad. The high-frequency (HF) components of sound attenuate more than its low-frequency (LF) components in propagation. At a distant location, as HF components attenuate more, definition is low and it is hard for a listener to hear clearly. Thus, it has difficulty in being used for large-area, long-distance or high sound-intensity broadcasting. And, to effectively modulate an airstream, it is necessary to operate under the state of big amplitude, and the present pneumatic loudspeakers cannot work for a long time without failure; so it is hard for them to be used in audio broadcasting of high sound-intensity.

Ling Electronics developed a loudspeaker that utilized sleeve valve modulation. FIG. 1 illustrates the operation principle of this loudspeaker of Ling Electronics, which has a sleeve valve formed by a movable ring 33 and a still ring 32. Annular slits are provided on the movable ring 33 and the still ring 32, and the slits on the movable ring 33 and the still ring 32 are in alignment with one another respectively. The slits allow the passage of airstream. When the movable ring shifts up and down relative to the still ring, the slits on the movable and still rings will be off-alignment, resulting in change in the cross-sectional area of the airstream passage, which in turn functions as a valve and changes the flow rate of airstream to realize modulation of airstream. The movable ring 33 of this loudspeaker is arranged on the outside of the still ring, so an airstream pushes the movable ring 33 towards the still ring 32; in addition, since the gap between the movable and still rings is very small, the area of contact is big, although the amount of air to be consumed is reduced; thus, a relatively strong frictional force is generated, which tends to result in damage or blockage.

In Chinese Patent No. ZL 92102274.3, the inventor of the present patent application proposed a jet-blocking loudspeaker, which is shown is FIG. 2 in its basic structure. As shown in FIG. 2, the loudspeaker comprises a housing formed by an upper housing body and a lower housing body. The upper end of the upper housing body is an opened port capable of connecting with a horn (not shown); silencer exhaust holes are provided on the side of the upper housing body. An air inlet port is provided at the central portion of the lower end of the lower housing body. A supporting plate is arranged between the upper and lower housing bodies to divide the internal space of the housing into an upper portion and a lower portion, which are communicated with each other through an air channel. A throat canal 2, a central cone 19, an annular nozzle 14, an obstructing ring 15, and a voice coil 13 and its leads are provided within the upper housing body; the lower end of the throat canal forms an annular flow-splitter 20, and the inner side of the flow-splitter and the outer wall of the central cone part form a throat channel. The obstructing ring 15 and the voice coil are pressed into an integral by a lower plate 17 and an upper plate 18 with a rubber support 16, so that the obstructing ring is accurately positioned while it is allowed to displace up and down by the elastic effect of the rubber ring (rubber support). A magnet and an inner magnetic pole 11 and an outer magnetic pole 10 connected with the magnet are arranged in the lower housing body.

Although this loudspeaker overcomes the defects of the sleeve valve pneumatic loudspeaker of Ling Electronics and can be used in high-power sound broadcasting, it has the following shortcomings:

1) The loudspeaker modulates the direction of a jet by obstructing the jet to achieve the object of converting the high-pressure airstream to pressure wave; however, since the annular flow-splitter 20 at the lower end of the throat canal 2 has a blunt-circular shape, the sensitivity of high-frequency modulation is low; in addition, a relatively big gap exists between the obstructing ring 15 and the annular nozzle 14, resulting in significant air leak and low efficiency of airstream utilization. As shown in FIG. 2, at positive half-cycle of signal the obstructing ring 15 moves down to allow the jet to rush into the throat canal 2 to generate acoustic waves, while at negative half-cycle the obstructing ring 15 moves up to direct the jet towards the flow-splitter 20 having a front edge of blunt-circular shape, and as the obstructing ring moves further up the jet is directed by the flow-splitter 20 backward to enter the silencer exhaust hole and is exhausted into the atmosphere. As the obstructing ring 15 is for altering the direction of the jet, there is a relatively big separation between it and the nozzle 14, resulting in that a portion of the airstream leaks through the gap between the obstructing ring 15 and the nozzle 14, and this portion of the airstream has no contribution to the sound-generation and is wastefully dissipated. As the front edge of the flow-splitter 20 used has a blunt circular shape, its flow-splitter sensitivity at high-frequency is low and the high-frequency effect is not satisfactory. Although its air-sound conversion efficiency improved significantly as compared with a sleeve valve loudspeaker, the efficiency of airstream utilization of ZL92102274.3 still needs to be improved.

2) As the obstructing ring 15 is made by titanium, eddy displacement current will be generated in a strong magnetic field, resulting in damping effect and heat generation; the higher the frequency, the greater the damping effect and the heat generation. Thus, the modulation efficiency at high frequency is relatively low, the temperature during operation is very high, and long-time stable operation is difficult to be realized. As the obstructing ring 15 is made by titanium (specific weight: 4.5), it is still relatively heavy, its resonance frequency is still relatively low, and its amplitude at high-frequency is relatively small, and it can hardly realize effective modulation; therefore, its air-sound conversion efficiency at high-frequency is low, its high-frequency range is generally below 3,500 Hz, and its definition at a distant location is inferior.

3) The signal power applied during the operation of the signal coil—voice coil 13 is relatively high (usually in the range of 400-2,000 Watts or higher), resulting in generation of a relatively large amount of heat, and its heat-dissipating measure is not adequate. The temperature of the exhausted gas of a general industrial air-compressor can often reach 90C., plus the heat produced by the eddy current generated in the integral metal voice coil 13 moving in a strong magnetic field, the temperature of the obstructing ring 15 and the voice coil 13 at operation is high and they are easy to fail, so they can not sustain long-time and fault-free operation.

4) Since the amplitude of the obstructing ring 15 is relatively large, the leads of the voice coil 13 are made of knitted copper threads, which is subject to breaking-off due to fatigue, leading to operation failure.

SUMMARY OF THE INVENTION

In consideration of the above, an object of the present invention is to provide a high-frequency pneumatic loudspeaker for sound broadcasting, which overcomes the defects of the prior art and which modulates the passage area while at the same time altering the direction of the jet, has the advantages of both the passage area modulation by a sleeve air valve and the airstream direction modulation by jet obstruction, reduces airstream consumption so as to improve air-sound conversion efficiency, and improves structures of annular flow-splitter, voice coil and leads. A high-frequency pneumatic loudspeaker for sound broadcasting of the present invention is also added with a cooling system. Thus, a high-frequency pneumatic loudspeaker for sound broadcasting of the present invention has improved high-frequency modulation sensitivity, operation stability, and/or extended fault-free operation time. It can be practically used for large area, long distance or high sound intensity broadcasting.

An embodiment of the present invention proposes a high-frequency pneumatic loudspeaker for sound broadcasting, which comprises a housing formed by an upper housing body and a lower housing body; the upper end of the upper housing body is opened; the side of the upper housing body is provided with silencer exhaust holes; the central portion of the lower end of the lower housing body has an air inlet port; a supporting plate is arranged between the upper and lower housing bodies and divides the internal space of the housing into an upper portion and a lower portion, which communicate with each other by an air channel. In the upper housing body, a throat canal, a central cone, an annular nozzle, an obstructing ring, and a voice coil and its leads are provided; the lower end of such a throat canal forms an annular flow-splitter; the inner side of the flow-splitter and the outer wall of the central cone form a throat channel; a lower plate and an upper plate and a rubber ring hold the obstructing ring and the voice coil in position; a magnet and inner and outer magnetic poles connected with the magnet are mounted in the lower housing body; the voice coil is arranged in a magnetic gap between the inner and the outer magnetic poles; a high-pressure air chamber is formed within the space between the outer magnetic pole and the lower housing body; high-pressure airstream enters into the high-pressure air chamber from the air inlet port and enters into the annular nozzle through a through-hole on the supporting plate; wherein a gap is provided between the obstructing ring and the end of the annular nozzle, and said gap avoids friction between the obstructing ring moving upward and downward and the end of the annular nozzle.

The end of said annular flow-splitter is an acute front edge.

In an embodiment of the present invention, a high-frequency pneumatic loudspeaker also comprises a cooling system, which comprises a through-hole provided on the bottom of the outer magnetic pole for communicating the high-pressure air chamber and the gap between the inner magnetic pole and the outer magnetic pole so that the gap between the inter magnetic pole and the outer magnetic pole forms a side cooling air channel; an upper cooling air channel is formed between the upper end of the inner magnetic pole and the lower plate; a central cooling air channel is formed at the central portions of the magnet and the inner magnetic pole for communication with the high-pressure air chamber and the upper cooling air channel.

In an embodiment, an obstructing ring is made of magnesium alloy, a voice coil under such an obstructing ring is made of fibrous composite thin-film and wrapped with a varnish aluminum wire, and such an obstructing ring and such a voice coil are held in position by a silicon rubber ring.

In an embodiment, each lead comprises a stranded cable of alloy steel threads, a sheath of copper thread braiding, a protecting sheath of woven fibers, and an outer insulating protecting sheath, arranged from the innermost to the outer side of such a lead in the above order.

Discussion will be made below to the operation principle, structural features and technical effects of an embodiment of the present invention.

The present invention utilizes a composite modulation of two modulation approaches; one of the two modulation approaches is to change the passage area by a sleeve valve, and the other of the two modulation approaches is to alter the airstream direction by jet-obstruction. The present invention realizes an aim of both raising sensitivity of modulation and reducing airstream consumption.

To raise the sensitivity of airstream modulation at high frequency, the flow-splitter of an embodiment of the present invention has the form of an acute front edge. In a high-speed airstream, airflow behind the acute splitting portion is unstable and is easy to be deflected, so its direction can be altered with high sensitivity. This is similar to on/off states, and the sensitivity of high-frequency modulation is raised and the high-frequency range is extended.

An embodiment of the present invention additionally includes a cooling system for cooling a voice coil and dissipating heat from it. Low-temperature airstreams absorb heat from both sides of such a voice coil so as to improve the reliability of operation of it. At the same time, magnet is kept at a relatively low temperature to avoid its demagnetization, allowing long-term and fault-free operation of the sound head of such a pneumatic loudspeaker.

To suppress eddy current, in an embodiment of the present invention, a voice coil is made of a thin-film of non-conducting fibrous composite of good stability, an obstructing ring is made of magnesium alloy, and a wire of such a voice coil is wrapped varnish aluminum wire. Such an obstructing ring made of magnesium alloy and such a thin-film made of fibrous composite are cemented together by high-strength glue. In such a way, eddy current is suppressed, damping effect is suppressed, and mass of movable parts is further reduced, so resonant frequency and efficiency of high-frequency modulation are raised.

Since the amplitude of obstructing ring during operation is large, its leads are often broken due to fatigue. To prolong the life of leads, a novel lead structure is designed in an embodiment of the present invention to allow leads to work for a long time without being broken, so duration of fault-free operation is extended.

By reducing airstream consumption, the present invention further raises air-sound efficiency. Very large acoustic power can be produced with an ordinary industrial air compressor, and the entire set of apparatus is of relatively small size, which can be accommodated in a standard container and can be easily equipped on vehicles or ships or installed at any places where large-area broadcasting is required, such as at a seaport, for alarming earthquake, tsunami, calamity and/or etc., or for city alarming.

As resonant frequency is raised, the high-frequency range can be extended to over 3,500 Hz, so remote definition is improved.

DETAILED DESCRIPTION OF THE PRESENT INVENTION

The present invention proposes a high-frequency pneumatic loudspeaker for sound broadcasting. Further description of its structure and operation principle will be made below with reference to the accompanying drawings and embodiments.

Figure 2:
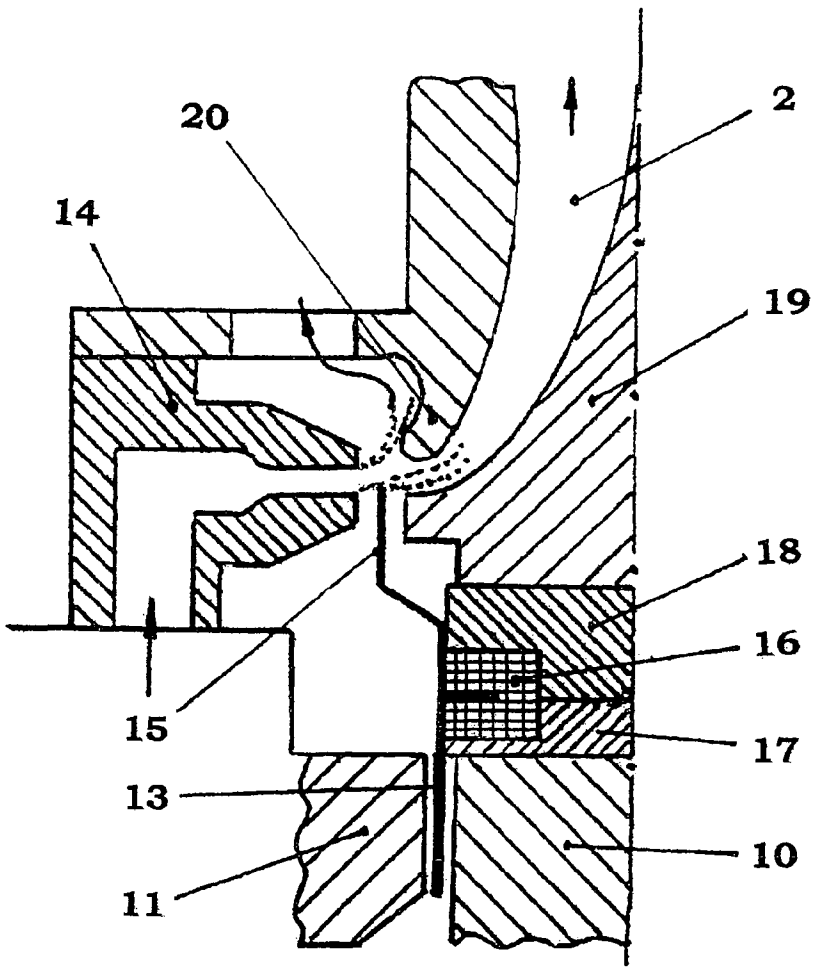
FIG. 2 PRIOR ART
FIG. 2 is a schematic view for illustrating operation of a jet-obstructing loudspeaker of the prior art.
Figure 1:
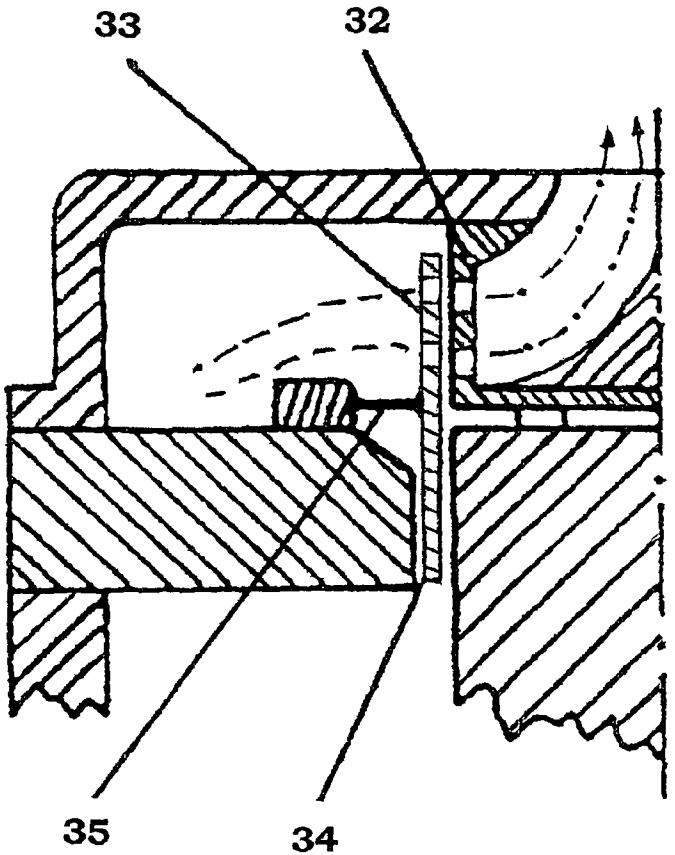
FIG. 1 PRIOR ART
FIG. 1 is a schematic view for illustrating operation of a sleeve valve pneumatic loudspeaker of the prior art.
Figure 3:
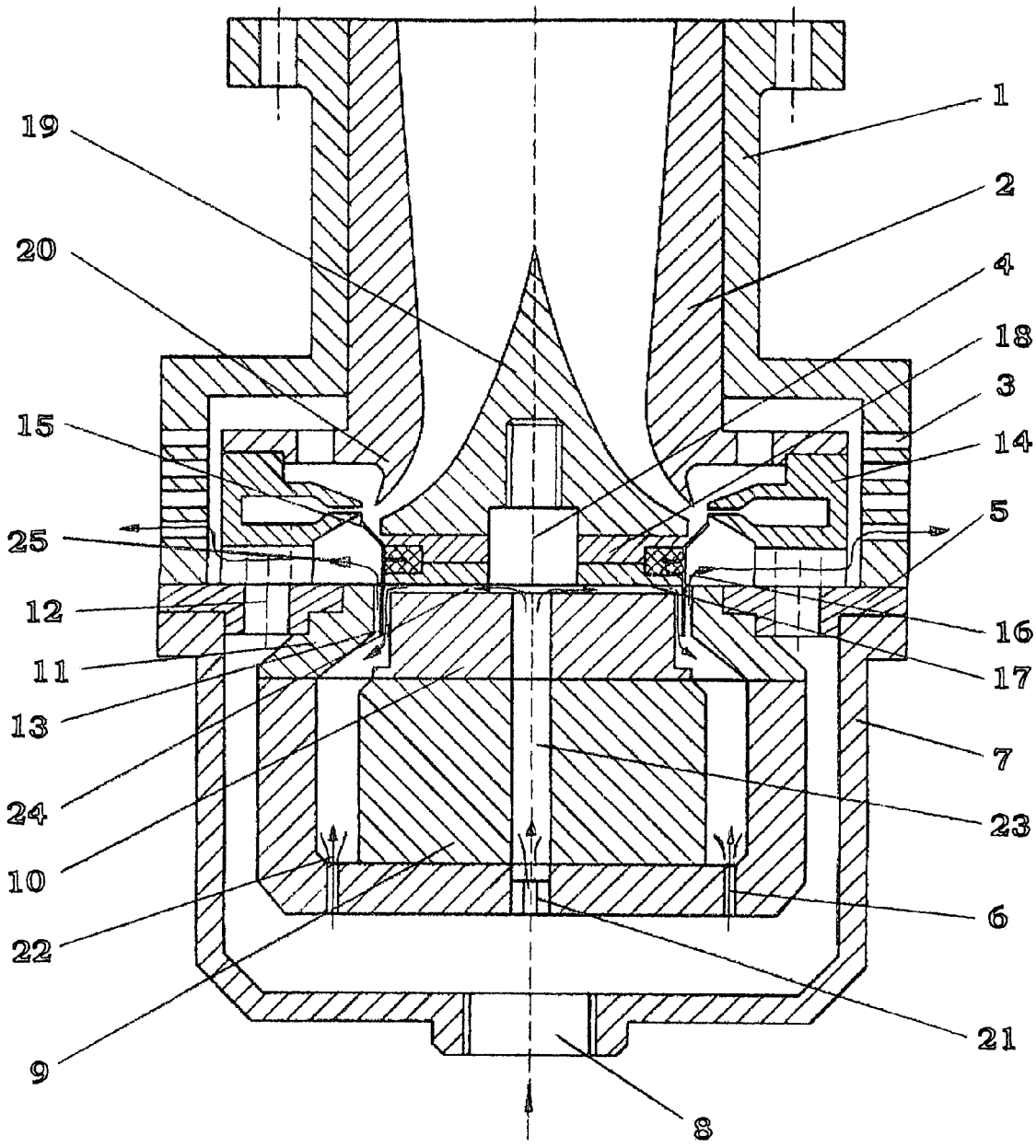
FIG. 3 is a schematic view for showing a structure of an embodiment of a high-frequency pneumatic loudspeaker of the present invention.
Figure 4:
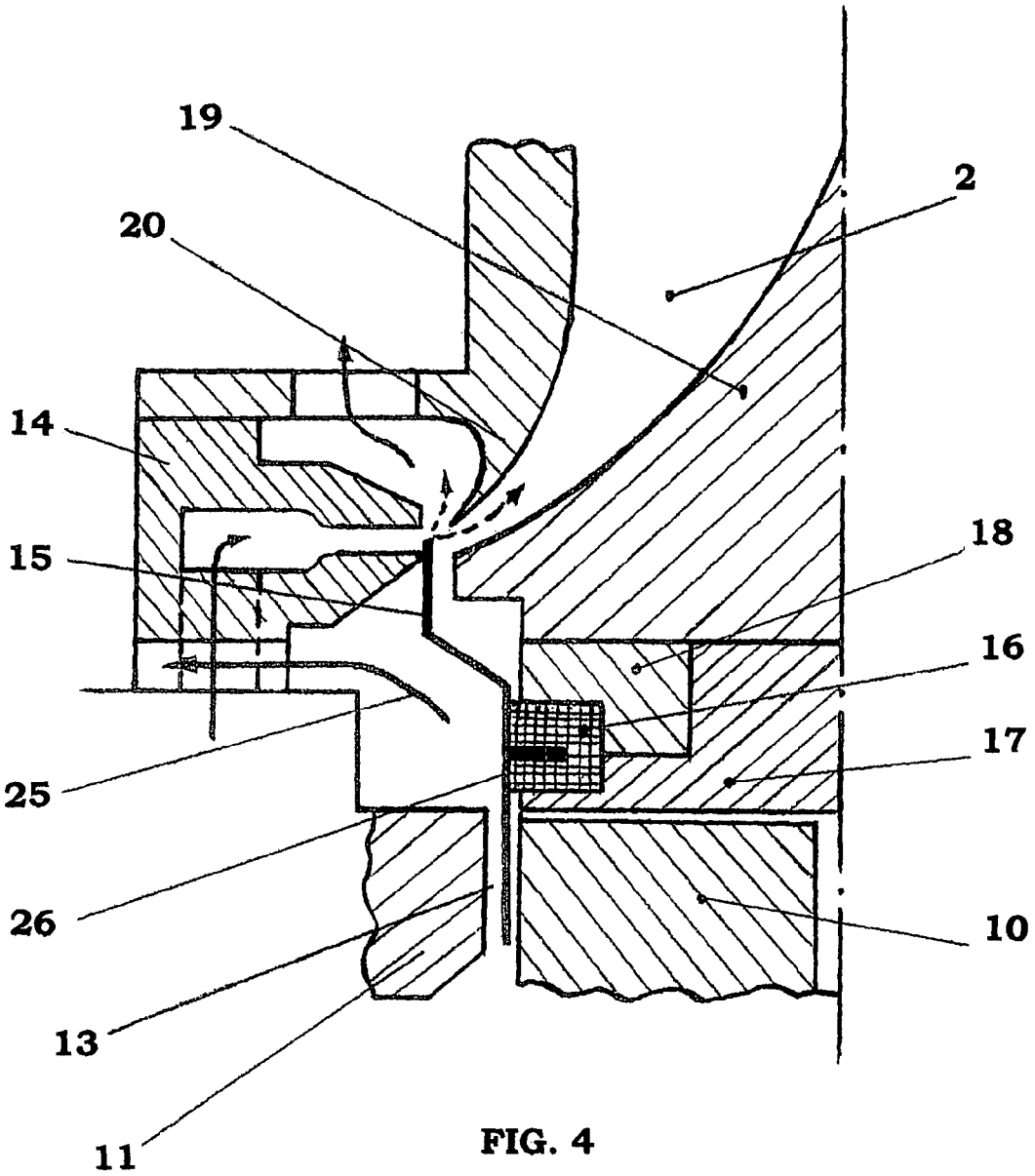
FIG. 4 is a schematic view for showing operation principle of a high-frequency pneumatic loudspeaker of the present invention.

An overall structure of a high-frequency pneumatic loudspeaker of an embodiment of the present invention is shown in FIG. 3. A loudspeaker as shown in FIG. 3 comprises a housing formed by an upper housing body 1 and a lower housing body 7. The upper end of upper housing body 1 is opened for connecting with a trumpet or an acoustic radiator (not shown). Silencer exhaust holes 3 are provided on the side of upper housing body 1. An air-inlet port 8 is provided at the central portion of the lower end of lower housing body 7. A supporting plate 5 is arranged between upper housing body 1 and lower housing body 7 to divide the space inside the housing into an upper portion and a lower portion, which communicate with each other through an air channel 12. A throat canal 2, a central cone part 19, an annular nozzle 14, an obstructing ring 15, and a voice coil 13 and its leads are provided within the upper housing body. An annular flow-splitter 20 is formed at the lower end of throat canal 2. The inner side of flow-splitter 20 and the outer wall of central cone 19 form a throat channel. Obstructing ring 15 and voice coil 13 are pressed into an integral by a lower plate 17 and an upper plate 18 through a rubber support 16. The central cone and the upper and lower plates are held in position by a screw 4. A magnet 9, an inner magnetic pole 10 and an outer magnetic pole 11 are mounted in the lower housing body. Voice coil 13 is placed in the magnetic gap between inner magnetic pole 10 and outer magnetic pole 11. A high-pressure chamber is formed in the space between the outer magnetic pole and the lower housing body. High-pressure airstream enters into the high-pressure chamber from air inlet port 8 and enters into annular nozzle 14 through air channel 12 on supporting plate 5. A small gap exists between obstructing ring 15 and the end of annular nozzle 14, for avoiding friction between the obstructing ring and the end of the nozzle when the obstructing ring slides up and down. The end of annular flow-splitter 20 is an acute front edge.

Operation Principle of an Embodiment of the Present Invention

An embodiment of the present invention utilizes composite modulation of two modulations, one of which is by changing passage area by a sleeve valve and the other one which is by altering the direction of airstream by jet-obstruction. FIG. 3 shown the operation principle of such an embodiment. A high-pressure airstream at for example 0.55 Mpa-0.65 Mpa enters through air inlet port 8, enters into annular nozzle 14 through annularly arranged air channel 12, and forms an annular thin jet at the outlet of nozzle 14. An obstructing ring 15, which can slide up and down, is arranged at the outlet of nozzle 14. An amplified acoustic signal is fed to voice coil 13, which is placed in a magnetic gap under high magnetic intensity, to generate a magnetic force for upward and downward push-and-pull. Obstructing ring 15 is held in position by a rubber support 16. The magnetic force for upward and downward pushes and pulls obstructing ring 15 against elastic counterforce of rubber support 16, causing obstructing ring 15 to slide up and down at the outlet of annular nozzle 14. At a positive half-cycle of the signal, obstructing ring 15 moves downward to fully open nozzle 14, and the annular thin jet completely charges into throat canal 2 to form pressure waves. At a negative half-cycle of the signal, obstructing ring 15 is pushed upward by the magnetic force to gradually diminish the passage area for nozzle 14, so the annular thin jet becomes thinner and at the same time its direction is altered upward towards flow-splitter 20; since a high-speed jet flowing by such an acute front edge is unstable and is easy to be deflected to the outer side, so the thinned annular thin jet is gradually deflected to the outer side of flow-splitter 20 and is discharged into the atmosphere through silencer exhaust holes 3; and the pressure in throat canal 2 gradually decreases. Due to dissipating effect on acoustic energy by silencer exhaust holes 3, it is not very noisy at the rear of such a sound-generating head. Since the gap between obstructing ring 15 and nozzle 14 is very small, when obstructing ring 15 moves further upward, nozzle 14 is completely obstructed and only a very little airstream can leak through the very small gap between obstructing ring 15 and nozzle 14, which is equivalent to the closure of a valve; thus, at a negative half-cycle of the signal, voice coil 13 moves upward to function as a sleeve valve, so the airstream consumption during negative half-cycle is reduced, and at this time the pressure in the throat canal reaches minimum.

When the signal gradually turns to positive, obstructing ring 15 gradually moves downward under the pulling effect the magnetic force to gradually open nozzle 14, and the airstream begins forming a slant jet. As obstructing ring 15 moves further downward, the opening for nozzle is gradually enlarged and the annular thin jet gradually becomes thicker and rushes towards flow-spitting 20. Since the annular thin jet is unstable, it is easy to be deflected to the inner side to rush to the throat canal. Thus, the sensitivity of high-frequency modulation is raised and the high-frequency range is extended.

Although there is only a very small gap between obstructing ring 15 and nozzle 14 of the present embodiment and obstructing ring 15 is in a sliding state, since obstructing ring 15 is at the inner side of nozzle 14, when high-pressure airstream in nozzle 14 rushes out, it rushes at obstructing ring 15 uniformly and pushes obstructing ring 15 towards the center, so no friction occurs even though the gap is very small; even if some localized friction occurs, its frictional force is very small.

Figure 5:
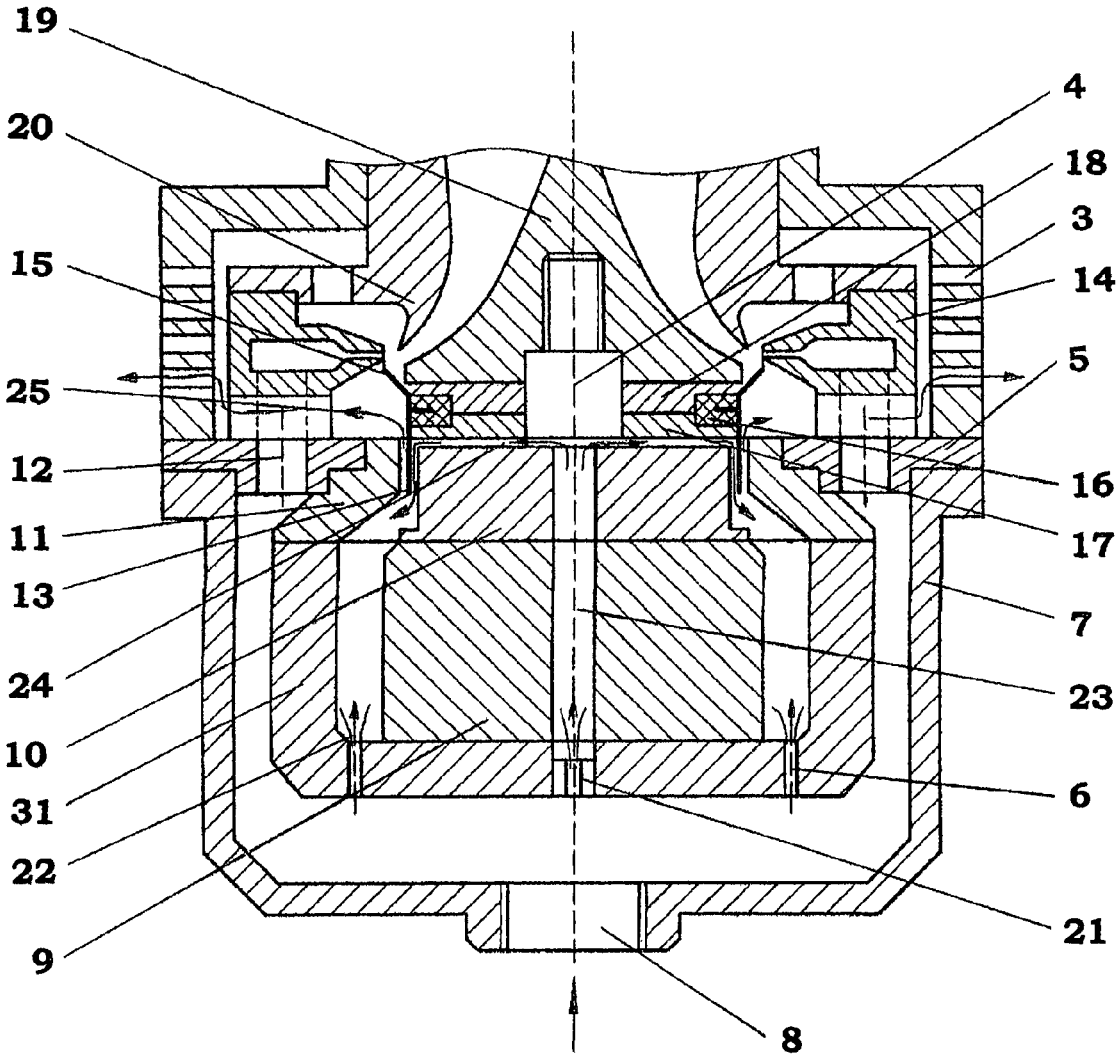
FIG. 5 is a schematic view for showing a structure of a cooling system of an embodiment of the present invention.

Since voice coil 13 at operation is applied with a large power of electric signal, which usually can reach a level of 400 Watts-2,000 Watts, a big amount of heat will be generated. In addition, the temperature of an airstream supplied by an air compressor can reach 90 C., so the temperature of voice coil 13 at operation would exceed 100 C. As such, voice coil 13 is easy to be burned. For cooling voice coil 13 and dissipating heat from it, and for cooling magnet, in an embodiment of the present invention a cooling system is designed. FIG. 5 shows a structure of such a cooling system of an embodiment of the present invention, which comprises two cooling air orifices 6 and 22 provided at the bottom of outer magnetic pole 11 for communicating the high-pressure air chamber with the gap between the inner magnetic pole and the outer magnetic pole, so that a side cooling air channel is formed by the gap between the inner magnetic pole and the outer magnetic pole. An upper cooling air channel 24 is provided between the upper end of the inner magnetic pole and the lower plate. A cooling air orifice 21 is opened at the central part of the outer magnetic pole. At the central parts of the inner magnetic pole and the magnet, a central cooling air channel 23 is formed, which communicates the high-pressure air chamber to the upper cooling air channel 24 through orifice 21.

During the operation of the cooling system, three airstreams are introduced from the air chamber into outer magnetic pole 31 through orifices 6, 22 and 21 respectively. As the interior of outer magnetic pole 31 communicates with the atmosphere, it is at relatively low pressure. High-pressure airstreams expand after they pass the orifices and their temperature drops. Expanded low-temperature airstream having passed orifices 6 and 22 flow by the outer side of voice coil 13, bring away heat from the outer side of voice coil 13, and form low-pressure airstreams 25, which are exhausted into the atmosphere through a channel formed below annular nozzle 14 and through exhaust holes 3 on upper housing body 1.

An expanded airstream having passed orifice 21 flows through central cooling air channel 23 and enters into upper cooling air channel 24 distributed over inner magnetic pole 10 and communicated with the magnetic gap. This low-pressure airstream flows by the inner side of voice coil 13 and, after it has cooled the inner side, joins airstream 25 at the outer side and is exhausted into the atmosphere. Such low-temperature airstreams bring away heat from both sides of voice coil 13 to realize cooling, and it cools magnet 9 at the same time so that demagnetization of magnet 9 due to high temperature is avoided. With such an effective cooling system, long-term fault-free operation of a pneumatic loudspeaker is guaranteed.

Figure 6:
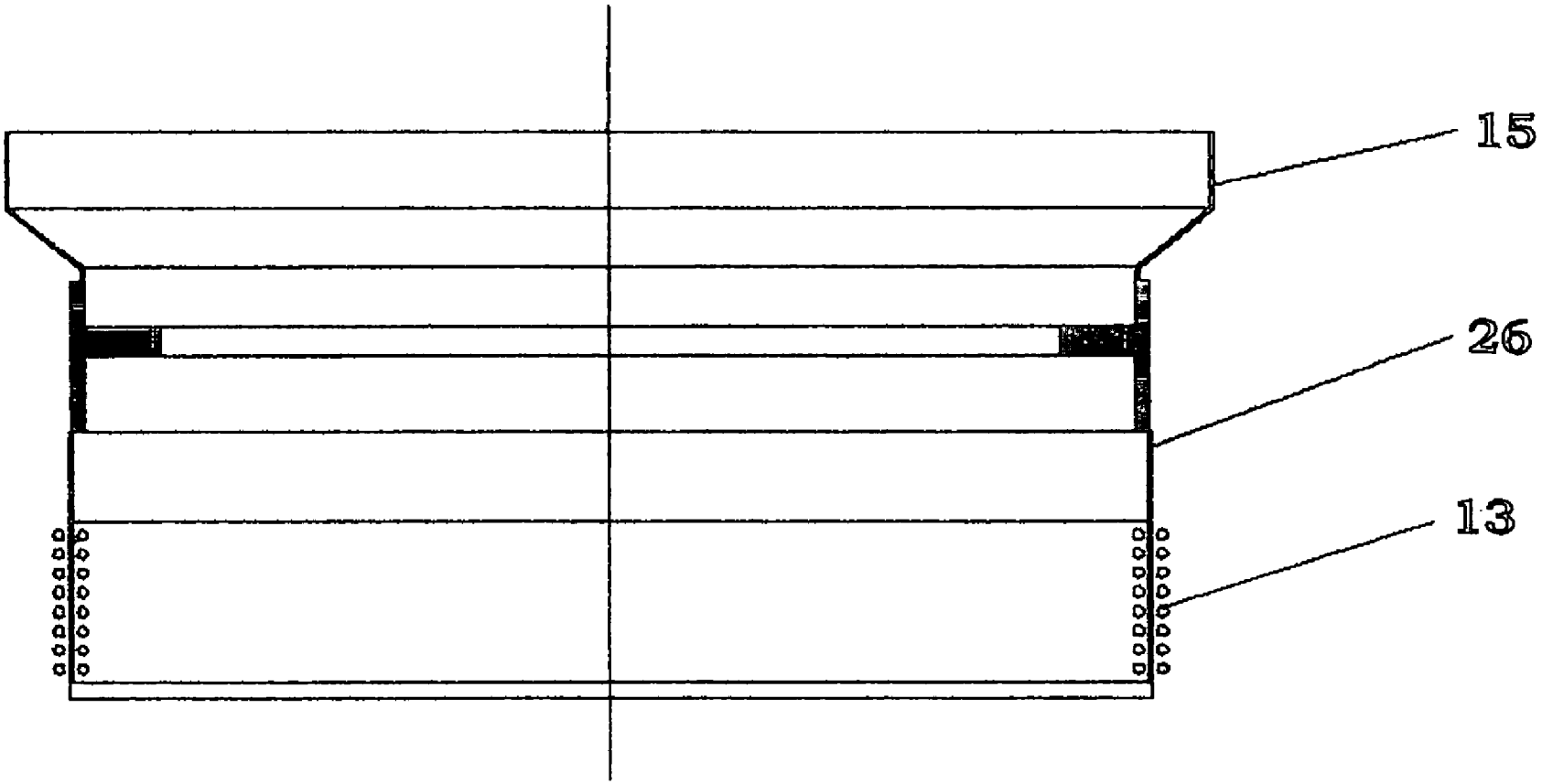
FIG. 6 is a schematic view for showing structures of an obstructing ring and a voice coil of an embodiment of the present invention.

FIG. 6 shows a structure of an obstructing ring and a voice coil of an embodiment of the present invention. In such an embodiment, a voice coil is made of a thin-film of non-conductive fibrous composite with good stability to suppress eddy current. Metal ring 15 for obstructing airstream is made of magnesium alloy (at a specific weight of for example 1.8). A voice coil part for being in a strong magnetic field is made of a thin film 26 of high-strength fibrous composite. Wire of voice coil 13 is wrapped varnish aluminum wire. Such a magnesium ring and such a composite thin film are joined together by high-strength glue; thus, eddy current is suppressed, damping effect is suppressed, and weight of movable parts is further reduced at the same time. Voice coil 13 is in a magnetic gap formed by inner magnetic pole 10 and outer magnetic pole 11. High-intensity magnet 9 enables generation of strong magnetic intensity in the magnetic gap, so that electromagnetic push-and-pull force is generated under the driving of signal power. Obstructing ring 15 is held in place by rubber support 16 arranged between upper plate 17 and lower plate 18 so that obstructing ring 15 can only move up and down. Elasticity of rubber support 16 determines the resonance frequency of the resonance system and can be adjusted to change the resonance frequency. So the resonance frequency is raised and the high-frequency range can reach over 3,500 Hz.

Figure 7:
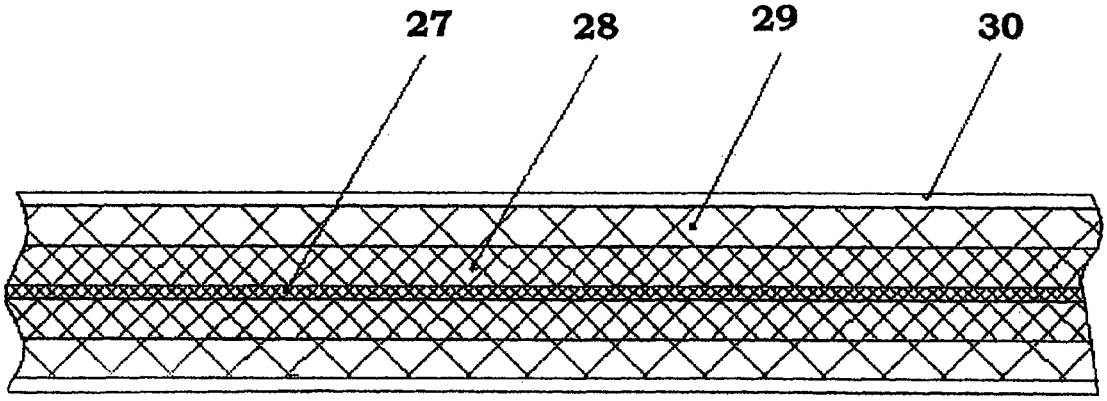
FIG. 7 is a schematic view for showing a structure of leads of an embodiment of the present invention.
Figure 8:
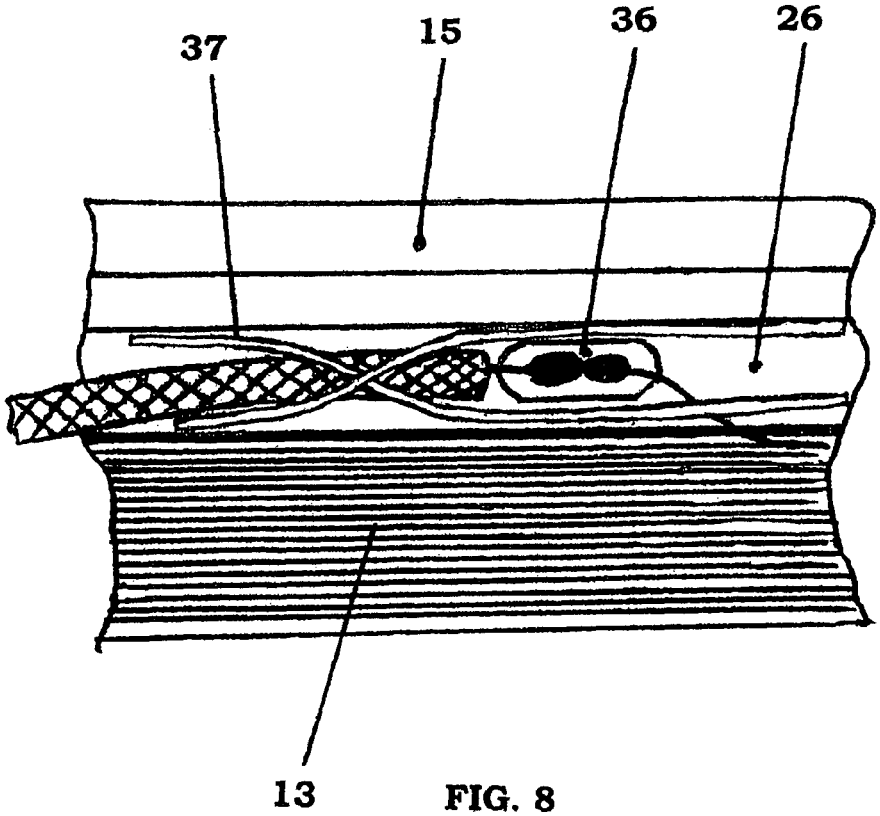
FIG. 8 is a schematic view for showing a lead connection of an embodiment of the present invention.

Since obstructing ring 15 during operation suffers large amplitude, its leads are often broken due to fatigue. To extend the life of leads, a novel structure of lead is designed in an embodiment of the present invention. As shown in FIG. 7, the core of such a lead is a stranded cable 27 of alloy steel threads, which is of high strength and high elasticity; a sheath 28 of elastic copper thread braiding having good conductivity is arranged outside stranded cable 27; a protecting sheath 29 of high-strength woven fibers is arranged outside sheath 28; and, an outer insulating protecting sheath 30 is arranged outside protecting sheath 29. Sheath 30 is preferably immersed by silicon rubber and is waterproof and moisture-proof. Such a lead is connected to the aluminum wire of voice coil 13 by a lug plate 36, and binding by high-strength fibers 37 is used, as shown in FIG. 8. A lead of such a structure can withstand long-term operation without being broken due to fatigue.

With such an embodiment of the present invention, very large sound power can be generated with an ordinary industrial air compressor, and the entire set of apparatus is of relatively small size, which can be accommodated in a standard container and can be easily equipped on vehicles or ships or installed at any places where large-area broadcasting is required, such as at a seaport, and/or for alarming earthquake, tsunami, or other calamity, and/or for city alarming.

In accordance with embodiments of the present invention, sound-generating heads of various sizes and output powers can be produced, each of which, in cooperation with a corresponding trumpet (not shown), can realize a high-frequency pneumatic loudspeaker for acoustic broadcasting in the frequency range of 50-3,500 Hz or higher.

Of course, various accommodations, modifications, improvements and/or variations in sizes and/or parts can be applied to the embodiments described above without departing from the scope of the invention as defined by the appended claims.

The invention claimed is:

1. A high-frequency pneumatic loudspeaker for sound broadcasting, comprising:

a housing formed by an upper housing body and a lower housing body, wherein an upper end of the upper housing body is opened, a side of the upper housing body is provided with silencer exhaust holes; a central portion of a lower end of the lower housing body has an air inlet port, a supporting plate arranged between the upper and lower housing bodies, wherein said supporting plate divides an internal space of the housing into an upper portion and a lower portion communicating with each other by an air channel, a throat canal, a central cone, an annular nozzle, an obstructing ring, a voice coil, and a lead of the voice coil provided in said upper housing body, wherein a lower end of said throat canal forms an annular flow-splitter, an inner side of the flow-splitter and an outer wall of the central cone form a throat channel, a lower plate and an upper plate for holding the obstructing ring and the voice coil in position, a magnet mounted in the lower housing body, and an inner magnetic pole and an outer magnetic pole mounted in the lower housing body and connected with the magnet, wherein the voice coil is arranged in a magnetic gap between the inner and the outer magnetic poles, a high-pressure air chamber is formed within a space between the outer magnetic pole and the lower housing body, and a high-pressure airstream is allowed to enter the high-pressure air chamber from said air inlet port and to enter the annular nozzle through said air channel, and wherein a gap is provided between the obstructing ring and an end of the annular nozzle, for avoiding friction between the obstructing ring moving upward and downward and the end of the annular nozzle, and a cooling system comprising:

a central cooling air channel formed at central portions of the magnet and the inner magnetic pole for communicating the high-pressure air chamber with an upper cooling air channel, said upper cooling air channel formed between an upper end of said inner magnetic pole and said lower plate, at least one side orifice formed on a bottom of the outer magnetic pole for communicating the high-pressure air chamber with a gap between the inner magnetic pole and the outer magnetic pole, and a central orifice formed at an entrance of said central cooling air channel, whereby a first stream of air going through said central orifice from said high-pressure air chamber is led to go through the gap between an inner side of said voice coil and the inner magnetic pole toward a free edge of the voice coil, where said first stream of air meets with a second stream of air going through said at least one side orifice and turns to go through the gap between an outer side of said voice coil and the outer magnetic pole, to exit said high-frequency pneumatic loudspeaker as low-pressure airstream through said silencer exhaust holes, wherein said first stream of air drops its temperature while it expands after it passes said central orifice, and said second stream of air drops its temperature while it expands after it passes said side orifice.

2. A high-frequency pneumatic loudspeaker as defined in claim 1, wherein an end of said annular flow-splitter is an acute front edge.

3. A high-frequency pneumatic loudspeaker as defined in claim 1, wherein said obstructing ring is made of magnesium alloy, the voice coil is under said obstructing ring and is made of fibrous composite thin-film and wrapped with a varnish aluminum wire, and said obstructing ring and said voice coil are held in position by a silicon rubber ring.

4. A high-frequency pneumatic loudspeaker as defined in claim 1, wherein said lead comprises a stranded cable of alloy steel threads, a sheath of copper thread braiding, a protecting sheath of woven fibers, and an outer insulating protecting sheath, arranged from the innermost to an outer side of said lead in the above order.

* * * * *